US007878166B2

(12) United States Patent
Wotherspoon et al.

(10) Patent No.: US 7,878,166 B2
(45) Date of Patent: Feb. 1, 2011

(54) DEVICE AND METHOD FOR RETAINING A VALVE BRIDGE

(75) Inventors: James Dougall Wotherspoon, Stamford (GB); Patrick Kirk Harris, Stamford (GB); Michael Robert Stott, Market Deeping (GB)

(73) Assignee: Perkins Engines Company Limited, Peterborough (GB)

( * ) Notice: Subject to any disclaimer, the term of this patent is extended or adjusted under 35 U.S.C. 154(b) by 447 days.

(21) Appl. No.: 11/987,326

(22) Filed: Nov. 29, 2007

(65) Prior Publication Data

US 2009/0139477 A1 Jun. 4, 2009

(51) Int. Cl.
*F01L 1/18* (2006.01)

(52) U.S. Cl. ..... 123/90.39; 123/90.41; 123/90.67; 74/569

(58) Field of Classification Search ..... 123/90.39, 123/90.41, 90.65, 90.66, 90.67; 74/559, 74/567, 569

See application file for complete search history.

(56) References Cited

U.S. PATENT DOCUMENTS

| | | | | |
|---|---|---|---|---|
| 1,410,771 | A | 3/1922 | Strohl | |
| 2,363,220 | A | 11/1944 | Alcorn | |
| 2,380,051 | A | 7/1945 | Kettering | |
| 2,824,555 | A | 2/1958 | Achilles | |
| 3,195,528 | A | 7/1965 | Stanley | |
| 3,280,806 | A | 10/1966 | Iskenderian | |
| 3,656,461 | A | 4/1972 | Renger et al. | |
| 4,327,677 | A | 5/1982 | Vander Bok | |
| 4,856,468 | A | 8/1989 | Speil et al. | |
| 5,337,712 | A | 8/1994 | Reitz | |
| 5,375,568 | A | 12/1994 | Manolis et al. | |
| 5,645,023 | A | 7/1997 | Regueiro | |
| 5,775,280 | A | 7/1998 | Schmidt et al. | |
| 6,047,675 | A | 4/2000 | Kunz | |
| 6,138,626 | A | 10/2000 | Speil | |
| 7,082,912 | B2 * | 8/2006 | Folino | 123/90.16 |
| 7,146,950 | B2 | 12/2006 | Moeck et al. | |
| 7,219,639 | B2 | 5/2007 | Engelhardt et al. | |

FOREIGN PATENT DOCUMENTS

| | | |
|---|---|---|
| DE | 4229411 | 3/1994 |
| DE | 19537641 | 4/1997 |
| EP | 1338836 | 8/2003 |
| EP | 1357266 | 10/2003 |
| EP | 1536107 | 6/2005 |

* cited by examiner

*Primary Examiner*—Ching Chang
(74) *Attorney, Agent, or Firm*—Finnegan, Henderson, farabow, Garrett & Dunner LLP

(57) ABSTRACT

A device for retaining a valve bridge is disclosed. The valve bridge is engaged with a plurality of valves. The device has a first base member. The first base member is configured to engage at least one of the plurality of valves. The device also has a first latching member. The first latching member extends from the first base member. The first latching member is configured to engage and retain the valve bridge in engagement with the plurality of valves.

24 Claims, 16 Drawing Sheets

DEVICE AND METHOD FOR RETAINING A VALVE BRIDGE

TECHNICAL FIELD

This disclosure is directed to a valve bridge and, more particularly, to a device and method for retaining a valve bridge.

BACKGROUND

An internal combustion engine, such as, for example, a diesel, gasoline, or natural gas engine, typically includes a cylinder block defining at least one cylinder and one or more of intake and exhaust valves. These valves may be actuated, i.e., selectively opened and closed, to control the amount of intake and exhaust gases that flow to and from the combustion chambers of the engine.

For maximum efficiency, it is generally desirable that the area of the intake and exhaust valves be maximized. To maximize this area, multiple intake valves and multiple exhaust valves are generally associated with each cylinder. In order to ensure that all of the intake valves move simultaneously and to the same lift amount, they are generally opened by a single actuator. The single actuator is connected to each of the intake valves by way of a valve bridge. The single actuator presses on the valve bridge which in turn opens the intake valves at the same time and to the same amount. A similar valve bridge arrangement may be employed for the exhaust valves.

The operational performance of the valve bridge may depend upon the connection between the valves and the valve bridge. The connection between the valves and the valve bridge may provide some clearance to allow for expansion due to heat and/or to allow lubrication between the parts. However, the connection should not be loose to permit the valve bridge to shift in relation to the valves during operation of the engine. In this situation, the valves may open undesirably, resulting in damage to the engine, or the valves may not open at all, resulting in an interruption in engine operation.

Efforts have been made to maintain the connection between the valve bridge and the valves. For example, U.S. Pat. No. 4,327,677 issued to Bok on May 4, 1982 ("the '677 patent"), discloses valves that are connected to the valve bridge through guide pins. Guide apertures extend centrally upward from the crowned contact surfaces of the valve bridge, and each aperture is configured to loosely receive a guide pin. The guide pins extend upwardly from the free end of a valve stem associated with each valve. The inside diameter of the guide apertures is larger than the outside diameter of the guide pins in order to compensate for variations in valve stem height.

Although the valve bridge arrangement of the '677 patent may be somewhat effective in compensating for valve stem height variations, it may be problematic. For example, the difference in diameters between the guide apertures and the guide pins provides a loose connection between the valves and the valve bridge. This loose connection may, in turn, allow the valve bridge to move relative to the valves, and may cause undesirable valve operation.

The device and method of the present disclosure are directed towards improvements in the existing technology.

SUMMARY

In one aspect, the present disclosure is directed to a device for retaining a valve bridge engaged with a plurality of valves. The device includes a first base member configured to engage at least a first one of the plurality of valves. The device also includes a first latching member that extends from the first base member. The first latching member is configured to engage and retain the valve bridge in engagement with the plurality of valves.

In another aspect, the present disclosure is directed to a method of retaining a valve bridge for operating a plurality of valves simultaneously. The method includes engaging the valve bridge with the plurality of valves. The method also includes engaging the valve bridge with a retainer configured to restrict the lateral motion of the valve bridge relative to the plurality of valves.

DETAILED DESCRIPTION

Figure 1:
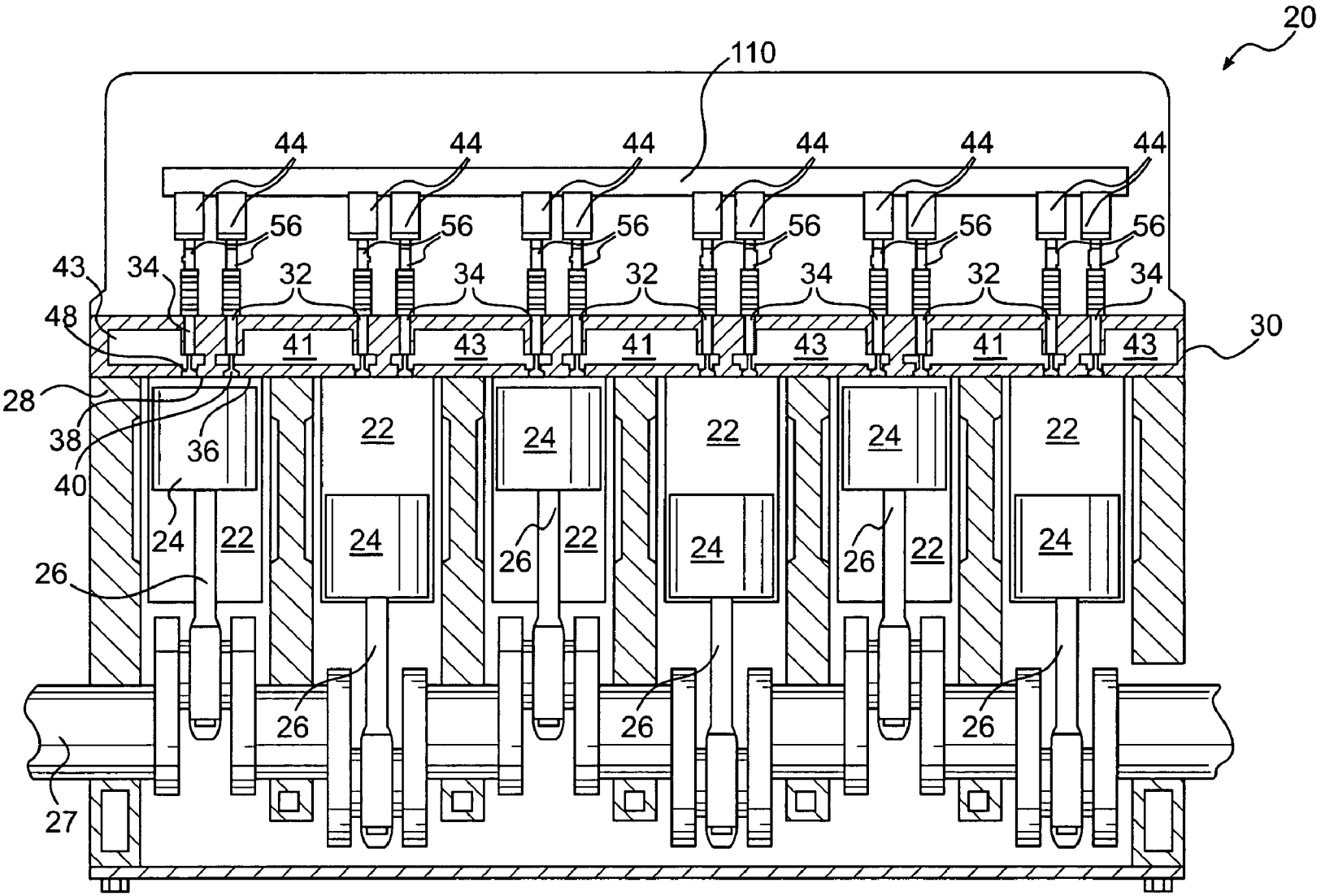
FIG. 1 is a diagrammatic cross-sectional view of an exemplary embodiment of an internal combustion engine.

An exemplary embodiment of an internal combustion engine 20 is illustrated in FIG. 1. For the purposes of the present disclosure, engine 20 is depicted and described as a four stroke diesel engine. One skilled in the art will recognize; however, that engine 20 may be any other type of internal combustion engine, such as, for example, a gasoline or natural gas engine.

As illustrated in FIG. 1, engine 20 may include an engine block 28, and may include a plurality of cylinders 22. A piston 24 may be slidably located within each cylinder 22. In the illustrated embodiment, engine 20 includes six cylinders 22 and six associated pistons 24. One skilled in the art will readily recognize that engine 20 may include a greater or lesser number of pistons 24 and that pistons 24 may be located in an "in-line" configuration, a "V" configuration, or any other conventional configuration.

As also shown in FIG. 1, engine 20 may include a crankshaft 27 rotatably associated with engine block 28. A connecting rod 26 may connect each piston 24 to crankshaft 27. Each piston 24 may be coupled to crankshaft 27 so that a sliding motion of piston 24 within the respective cylinder 22 results in a rotation of crankshaft 27. Similarly, a rotation of crankshaft 27 will result in a sliding motion of piston 24.

Engine 20 may also include a cylinder head 30. Cylinder head 30 may include an intake passageway 41 that leads to at least one intake port 36 for each cylinder 22. Cylinder head 30 may further include two or more intake ports 36 for each cylinder 22. An intake valve 32 may be associated with each intake port 36. Intake valve 32 may include a valve element 40 configured to selectively block intake port 36. As described in greater detail below, each intake valve 32 may be actuated to move or "lift" valve element 40 to thereby open a respective intake port 36. In a cylinder 22 having a pair of intake ports 36 and a pair of intake valves 32, the pair of intake valves 32 may be actuated by a single valve actuation assembly 44 or by a pair of valve actuation assemblies 44.

Cylinder head 30 may also include at least one exhaust port 38 for each cylinder 22. Each exhaust port 38 may lead from a respective cylinder 22 to an exhaust passageway 43. Cylinder head 30 may also include two or more exhaust ports 38 for each cylinder 22. An exhaust valve 34 may be associated with each exhaust port 38. Exhaust valve 34 may include a valve element 48 configured to selectively block exhaust port 38. As described in greater detail below, each exhaust valve 34 may be actuated to move or "lift" valve element 48 to thereby open the respective exhaust port 38. In a cylinder 22 having a pair of exhaust ports 38 and a pair of exhaust valves 34, the pair of exhaust valves 34 may be actuated by a single valve actuation assembly 44 or by a pair of valve actuation assemblies 44.

Figure 2:
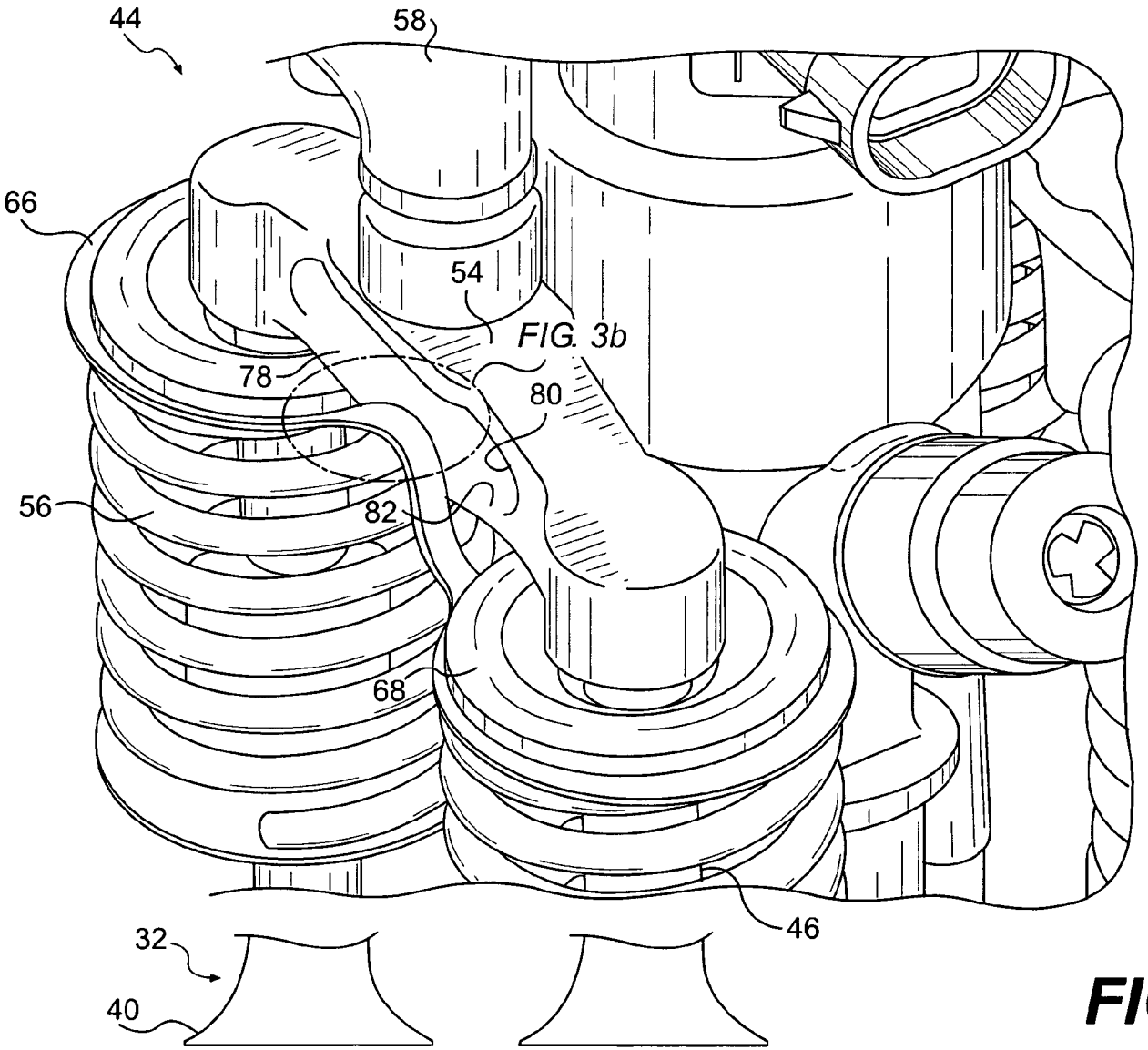
FIG. 2 is a schematic and diagrammatic illustration of a valve actuation assembly in accordance with an exemplary embodiment of the disclosure.

FIG. 2 illustrates an exemplary embodiment of a portion of an engine valve actuation assembly 44. A valve actuation assembly 44 may be operatively associated with a pair of intake valves 32, for example. Valve actuation assembly 44 may include a valve bridge 54 connected to each valve element 40 through a pair of valve stems 46. Valve bridge 54 may include ends that are closed as shown in FIGS. 2-9*b*. A valve spring 56 may be located around each valve stem 46 between cylinder head 30 (referring to FIG. 1) and valve bridge 54, for example. Valve springs 56 may act to bias valve elements 40 into engagement with respective valve seats (not shown) to thereby close intake ports 36. Valve actuation assembly 44 may also include a rocker arm 58. Rocker arm 58 may be configured to move about a pivot (not shown). One end of rocker arm 58 may be connected to valve bridge 54. The opposite end of rocker arm 58 may be connected to a cam assembly 110 (referring to FIG. 1). Cam assembly 110 may include one or more cams (not shown) that acts on rocker arm 58 to actuate (i.e., selectively open and close) intake valves 32.

Still referring to FIG. 2, valve actuation assembly 44 may include a valve bridge retainer 66 operatively connected to valve bridge 54 and operatively connected to a valve spring retainer 68 associated with valve spring 56. In accordance with exemplary embodiments of FIGS. 3*a*-9*b* and described below, valve bridge retainer 66 may assume a number of different configurations to control the motion of valve bridge 54 relative to valve elements 40. At least some of the exemplary embodiments of valve bridge retainer 66 may restrict the axial motion of valve bridge 54 relative to valve elements 40 so that a positive connection is maintained between valve bridge retainer 66 and valve bridge 54 during actuation of intake valves 32. On the other hand, at least one of the exemplary embodiments of valve bridge retainer 66 may restrict the lateral motion of valve bridge 54 relative to valve elements 40 and may allow axial motion of valve bridge 54 relative to valve elements 40 so that valve bridge 54 may move towards or away from valve elements 40. As will be apparent from FIG. 2 and at least some of the exemplary embodiments illustrated in FIGS. 3*a*-9*b*, valve bridge 54 may include a central recess 78. Central recess 78 may include a top inner surface 80 and a bottom inner surface 82. In the exemplary embodiments, valve bridge retainer 66 may be constructed from flexible materials.

Figure 3A:
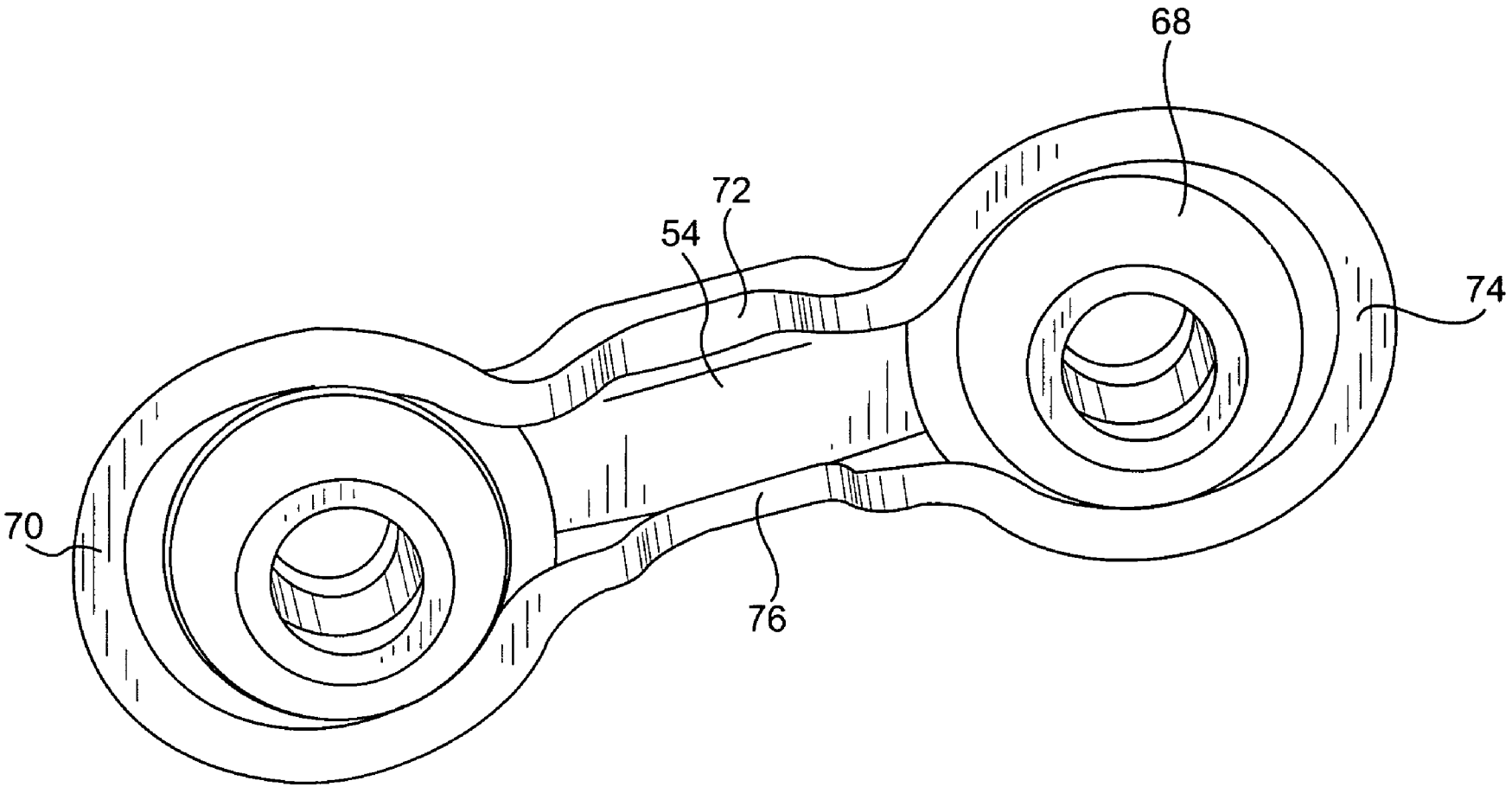
FIG. 3*a* is a diagrammatic view of a retainer for use with the valve bridge in FIG. 2.

As shown in FIG. 3*a*, valve bridge retainer 66 may include a first base member 70, a first latching member 72, a second base member 74, and a second latching member 76. First base member 70 and second base member 74 may be generally circular and planar. First base member 70 and second base member 74 may be located between valve spring retainer 68 and valve spring 56 (referring to FIG. 2). First latching member 72 may form an extension from first base member 70. The extension may be curved so as to contact one side portion of valve bridge 54 at approximately the mid-point of valve bridge 54. Second latching member 76 may extend from second base member 74 and may also be curved so as to contact another side portion of valve bridge 54 at approximately the mid-point of valve bridge 54.

Figure 3B:
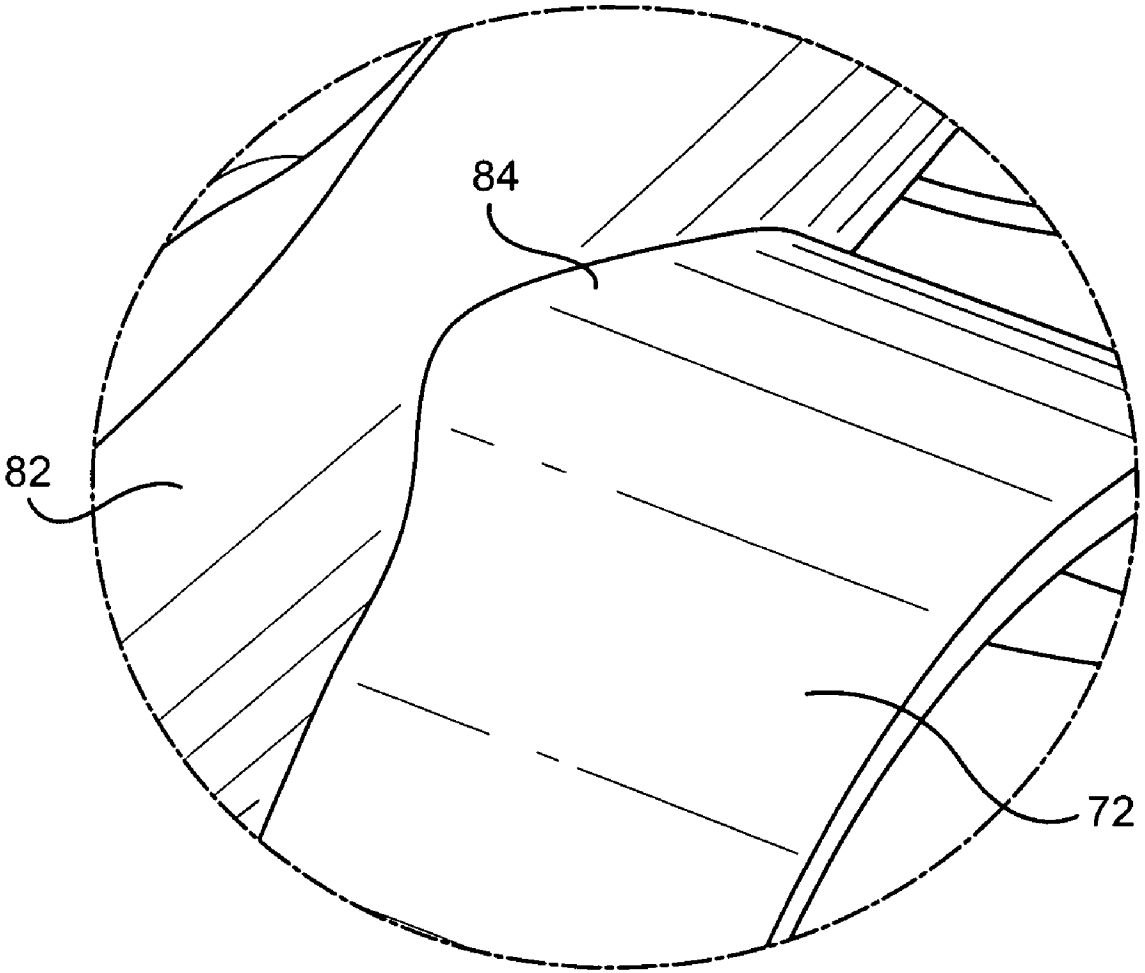
FIG. 3*b* is an enlarged diagrammatic view of a portion of the retainer in FIG. 3*a*.

As illustrated in FIG. 3*b*, first latching member 72 may include a first protrusion 84. First protrusion 84 may extend from about the mid-point of the first latching member 72 toward central recess 78. First protrusion 84 may overlap a portion of bottom inner surface 82, thereby retaining valve bridge 54 in contact with valve stems 46 (referring to FIG. 2). While FIG. 3*b* depicts the engagement of first latching member 72 with central recess 78, a person of ordinary skill in the art will appreciate that second latching member 76 may engage central recess 78 in a similar manner.

Figure 4A:
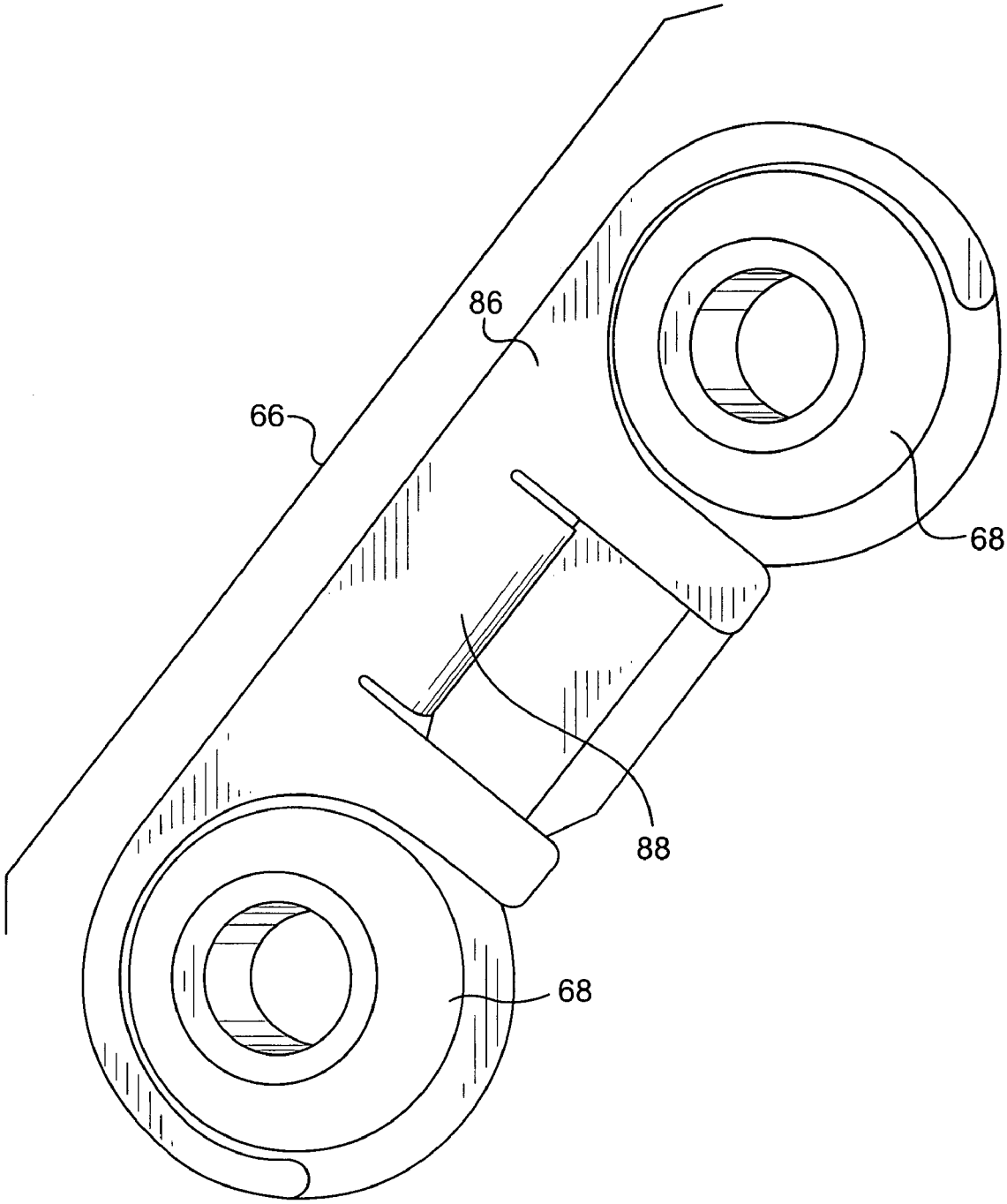
FIG. 4*a* is a diagrammatic view of a retainer for use with the valve bridge in FIG. 2.
Figure 4B:
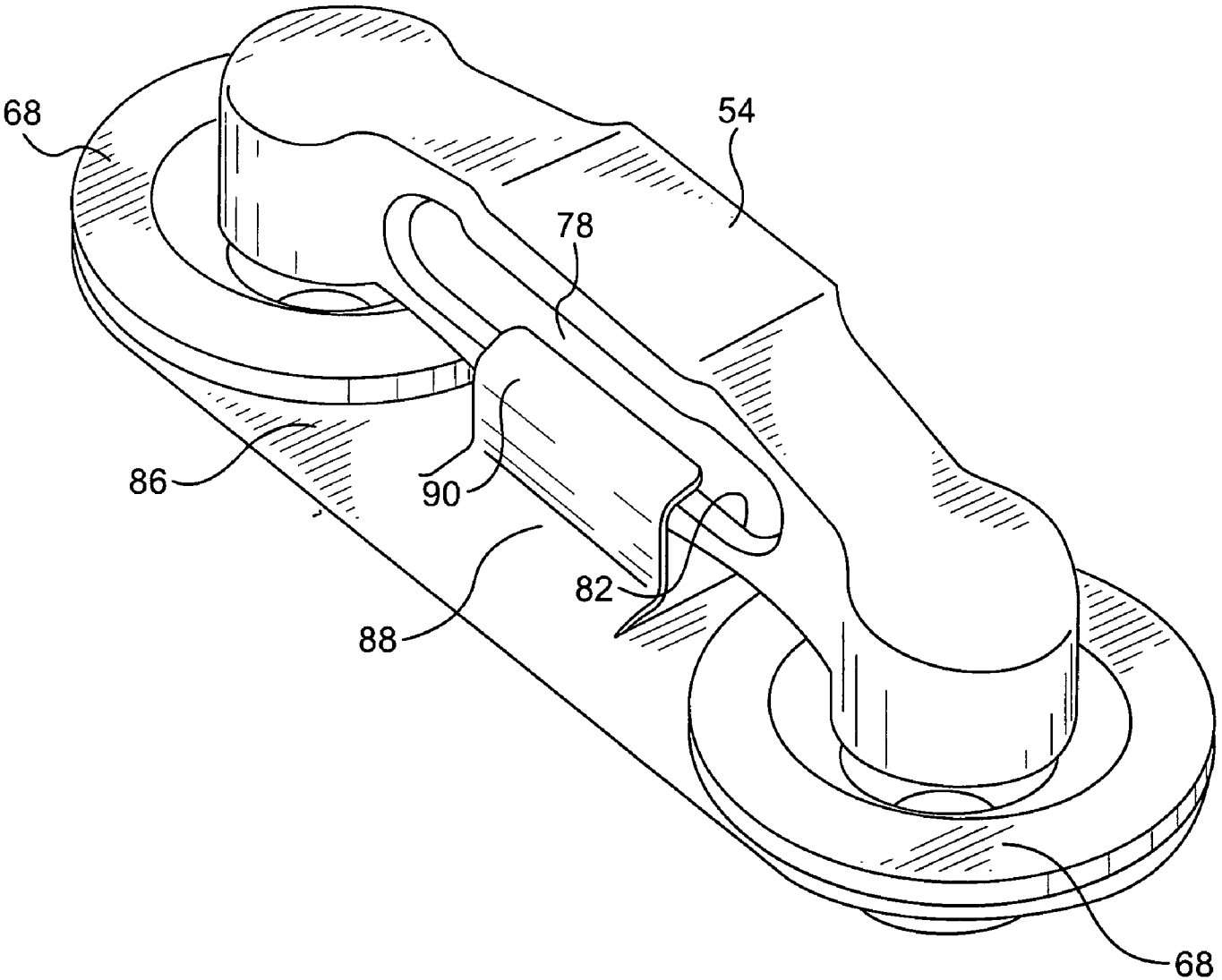
FIG. 4*b* is another view of the retainer in FIG. 4*a;*

In the exemplary embodiment illustrated in FIGS. 4*a* and 4*b*, valve bridge retainer 66 may include a base member 86, a latching member 88, and a protrusion 90. Base 86 may be located between two valve springs 56 (referring to FIG. 2) and their respective valve spring retainers 68. Latching member 88 may extend substantially upward from a mid-portion of base member 86 to a distance where protrusion 90 may extend from latching member 88 and overlap a portion of bottom inner surface 82 of central recess 78 of valve bridge 54.

Figure 5A:
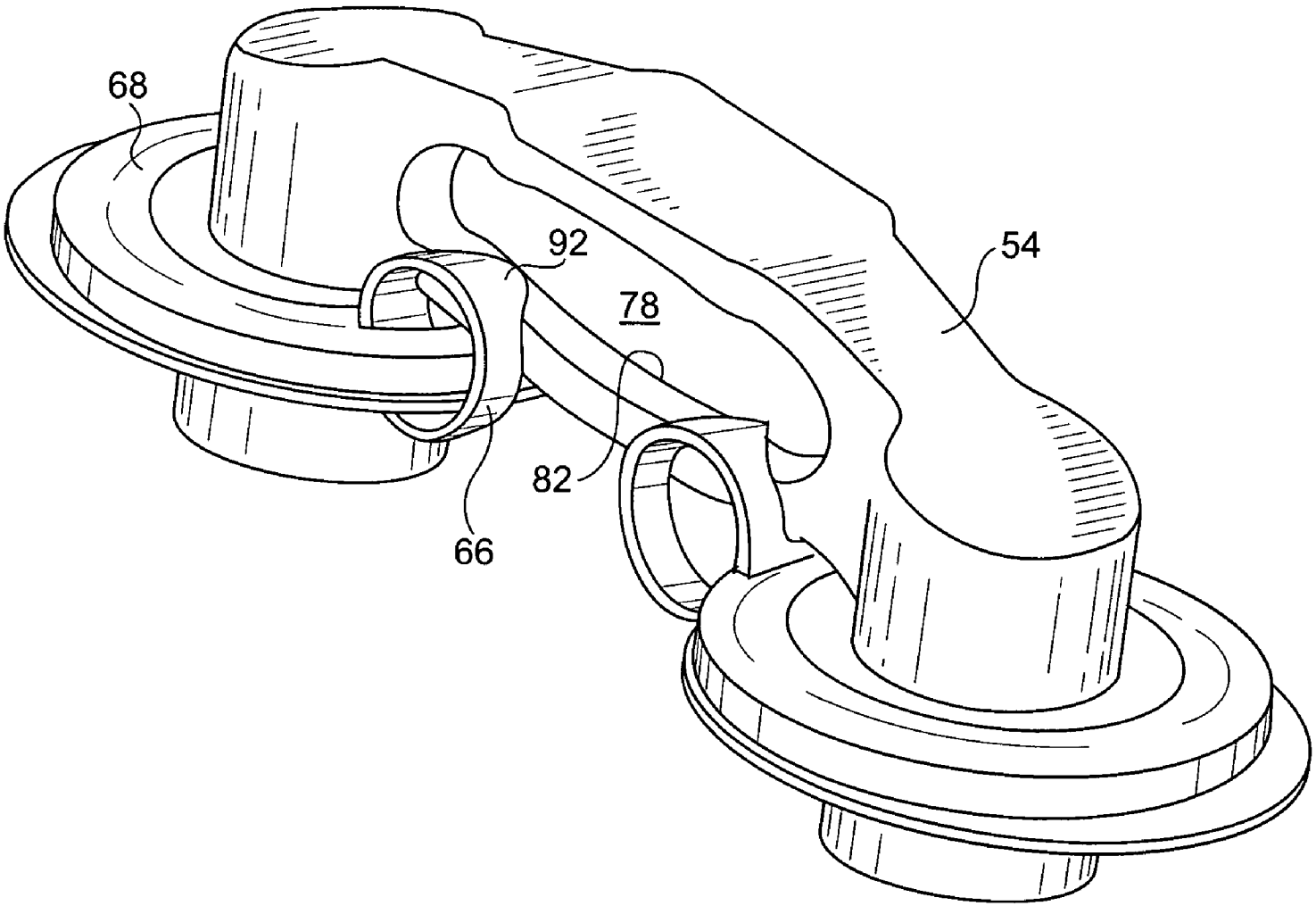
FIG. 5*a* is a diagrammatic view of a retainer for use with the valve bridge in FIG. 2.
Figure 5B:
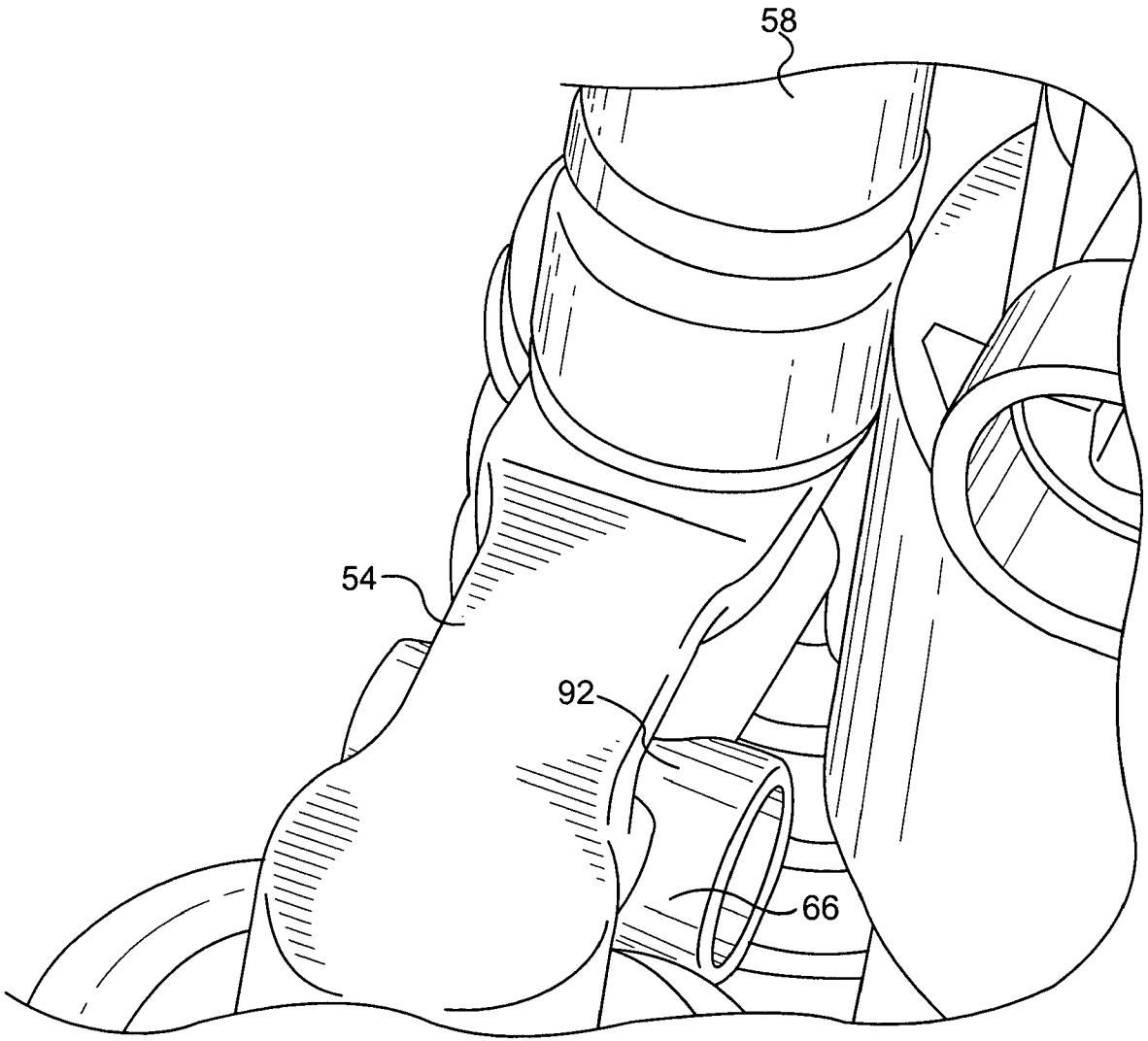
FIG. 5*b* is another view of the retainer in FIG. 5*a;*

In the exemplary embodiment illustrated in FIGS. 5*a* and 5*b*, valve bridge retainer 66 may include a cylindrical body with a cut-out portion capable of receiving and enclosing a portion of valve spring retainer 68. Valve bridge retainer 66 may include a latching member 92 protruding from the outer surface of the generally cylindrical body of valve bridge retainer 66 and overlapping a portion of bottom inner surface 82 of central recess 78 of valve bridge 54.

Figure 6A:
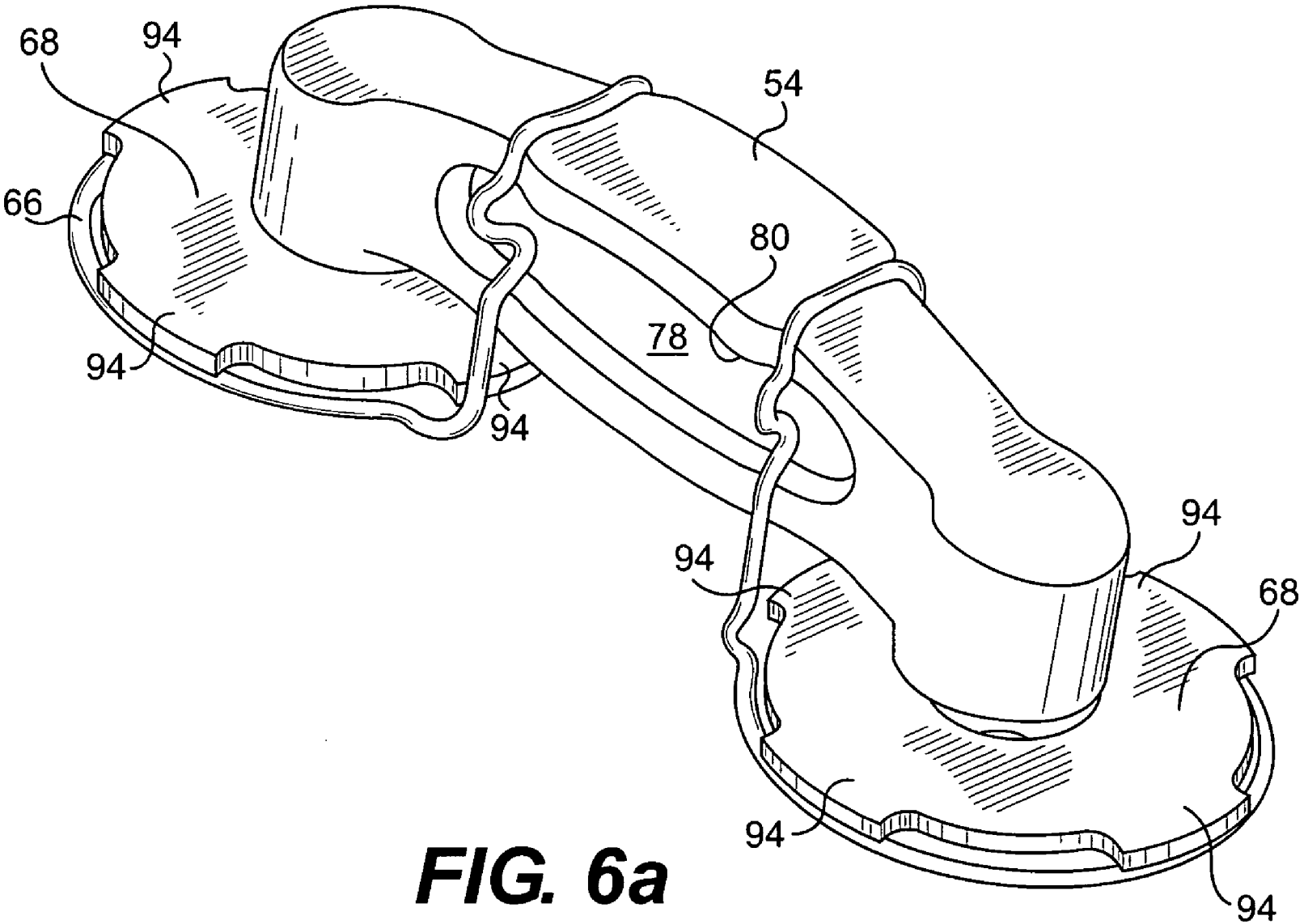
FIG. 6*a* is a diagrammatic view of a retainer for use with the valve bridge in FIG. 2.
Figure 6B:
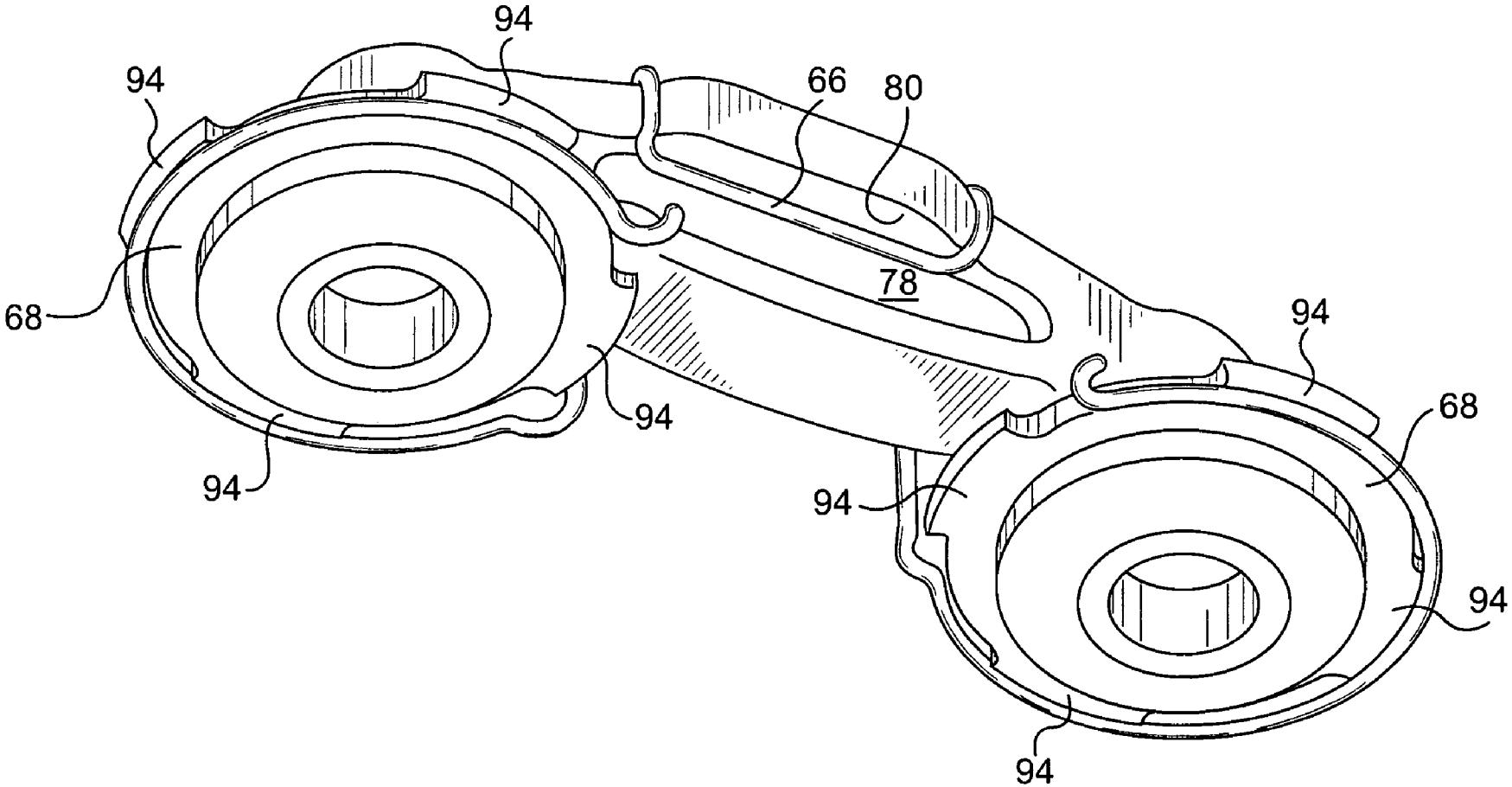
FIG. 6*b* is a view from beneath the retainer in FIG. 6*a;*

In the exemplary embodiment illustrated in FIGS. 6*a* and 6*b*, valve spring retainers 68 may include a generally circular and planar portion with a plurality of radial protrusions 94. Radial protrusions 94 may project away from the center of the generally circular and planar portion of valve spring retainers 68. Radial protrusions 94 may be equally spaced apart, for example. Valve bridge retainer 66 may be formed with an open wire-like clip. The clip may have a first end located beneath the generally circular and planar portion of one valve spring retainer 68 and between two radial protrusions 94 of valve spring retainer 68. The clip may then partially trace the contour of the generally circular and planar portion of valve spring retainer 68. The clip may extend over a top portion of valve bridge 54 (as shown in FIG. 6*a*) with a length of the wire-like clip contacting a section of top inner surface 80 of central recess 78 (as illustrated in FIG. 6*b*). The clip may continue to partially trace the contour of the generally circular and planar portion of another valve spring retainer 68. The clip may have a second end located beneath the generally circular and planar portion of the other valve spring retainer 68 and between two radial protrusions 94 of the other valve spring retainer 68.

Figure 7A:
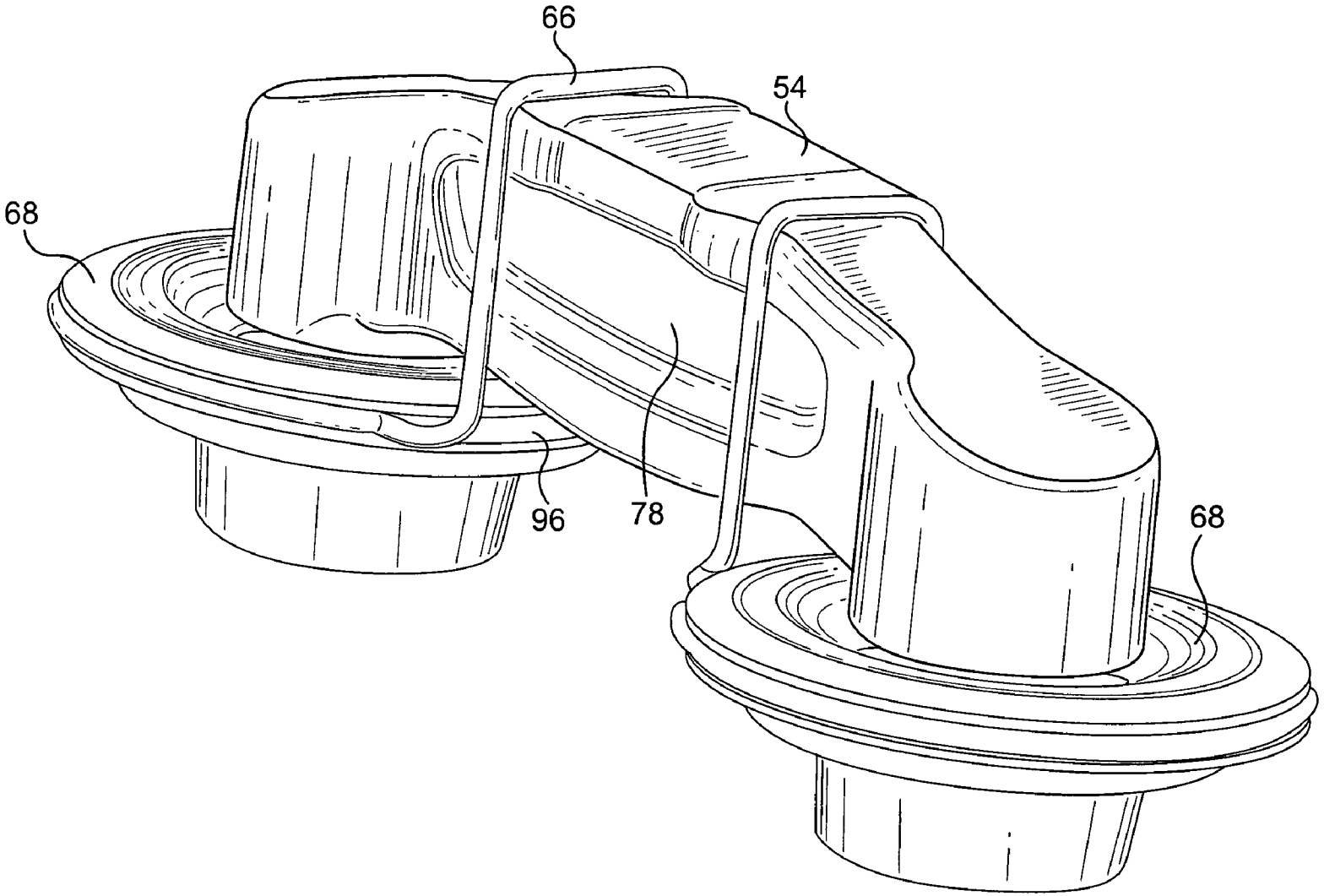
FIG. 7*a* is a diagrammatic view of a retainer for use with the valve bridge in FIG. 2.
Figure 7B:
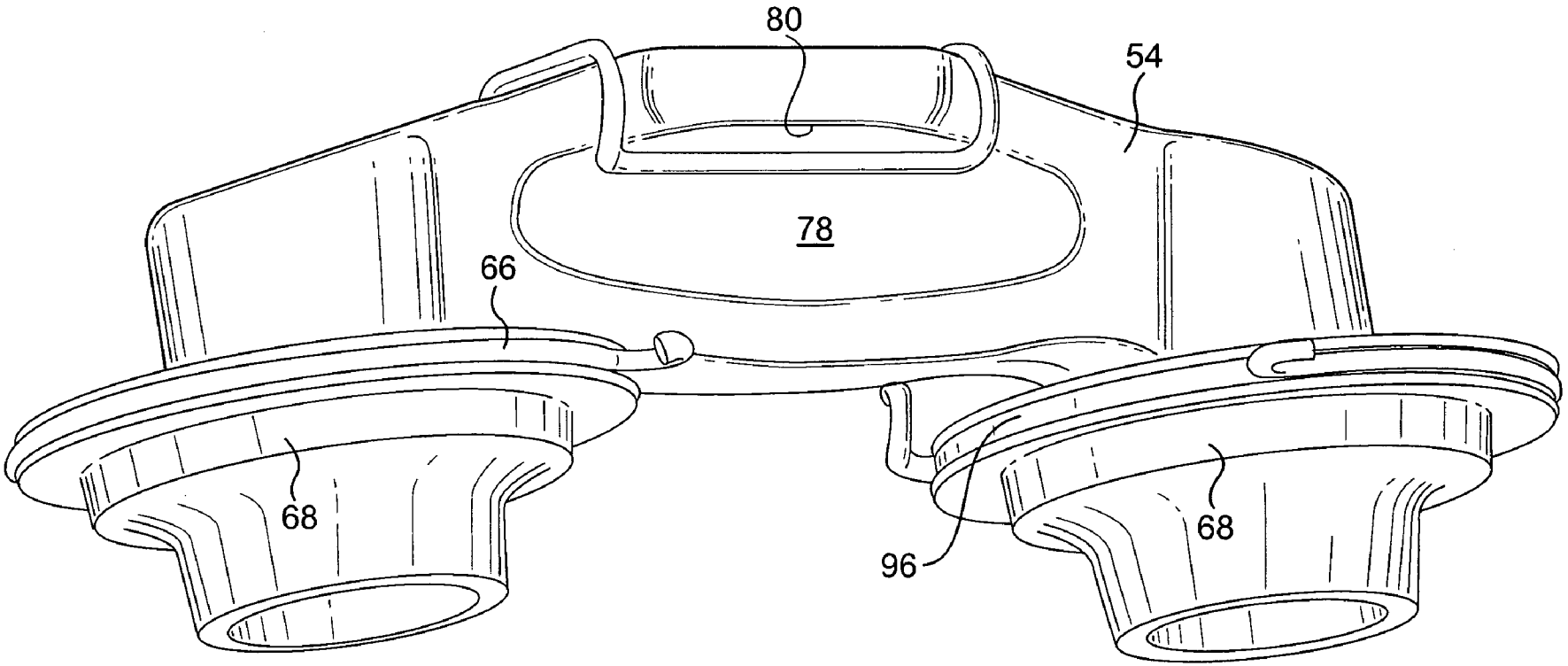
FIG. 7*b* is another view of the retainer in FIG. 7*a;*

In the exemplary embodiment illustrated in FIGS. 7*a* and 7*b*, valve spring retainers 68 may include a generally cylindrical body. The generally cylindrical body may include a central groove 96. Valve bridge retainer 66 may be formed with an open wire-like clip. The clip may have a first end located within central groove 96 of one valve spring retainer 68. The clip may partially trace the contour of the generally cylindrical body of valve spring retainer 68. The clip may extend over a top portion of valve bridge 54 (as shown in FIG. 7*a*) with a length of the wire-like clip contacting a section of top inner surface 80 of central recess 78 (as illustrated in FIG. 7*b*). The clip may continue to partially trace the contour of the generally cylindrical body of another valve spring retainer 68. The clip may have a second end located within central groove 96 of the other valve spring retainer 68.

Figure 8A:
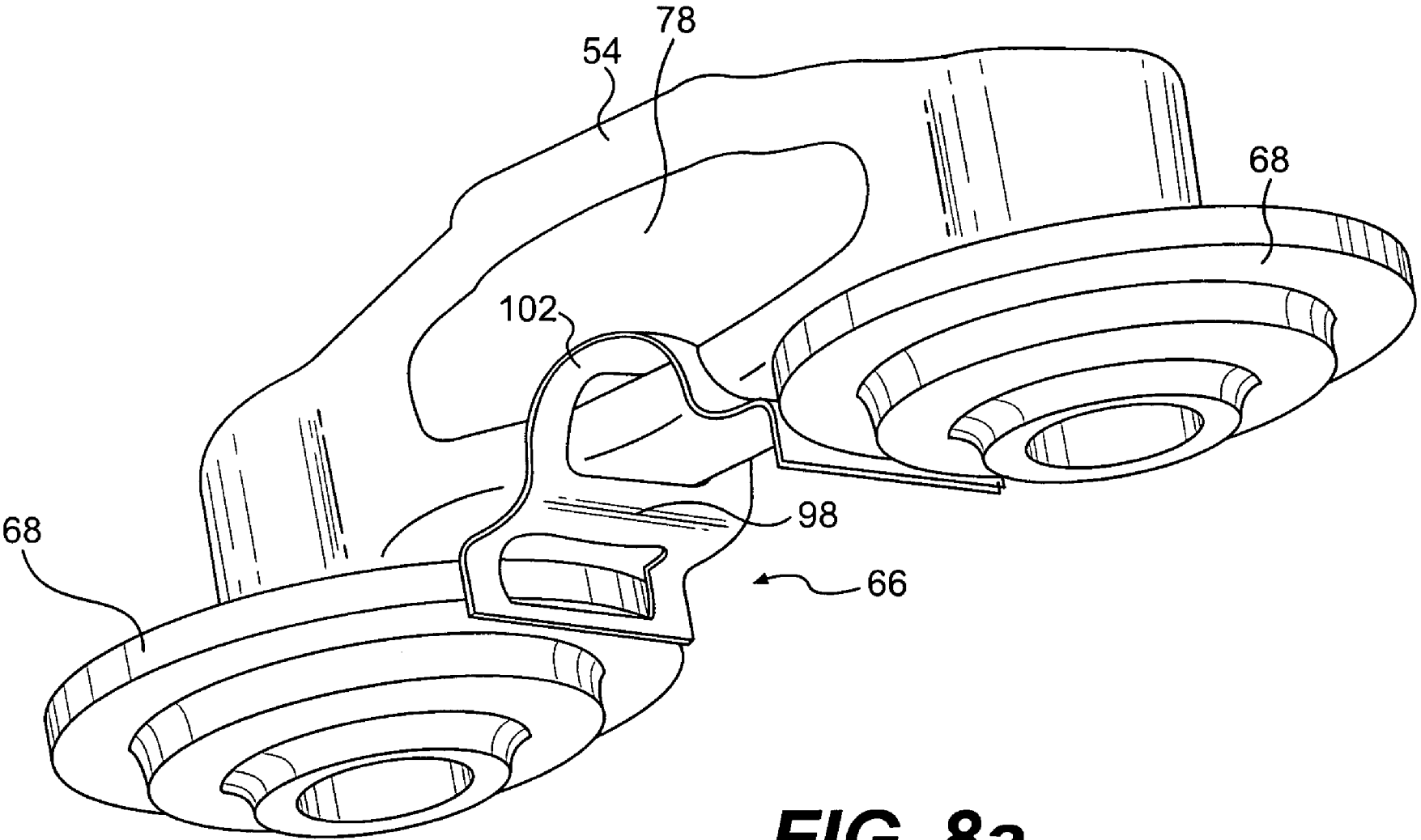
FIG. 8*a* is a diagrammatic view of a retainer for use with the valve bridge in FIG. 2.
Figure 8B:
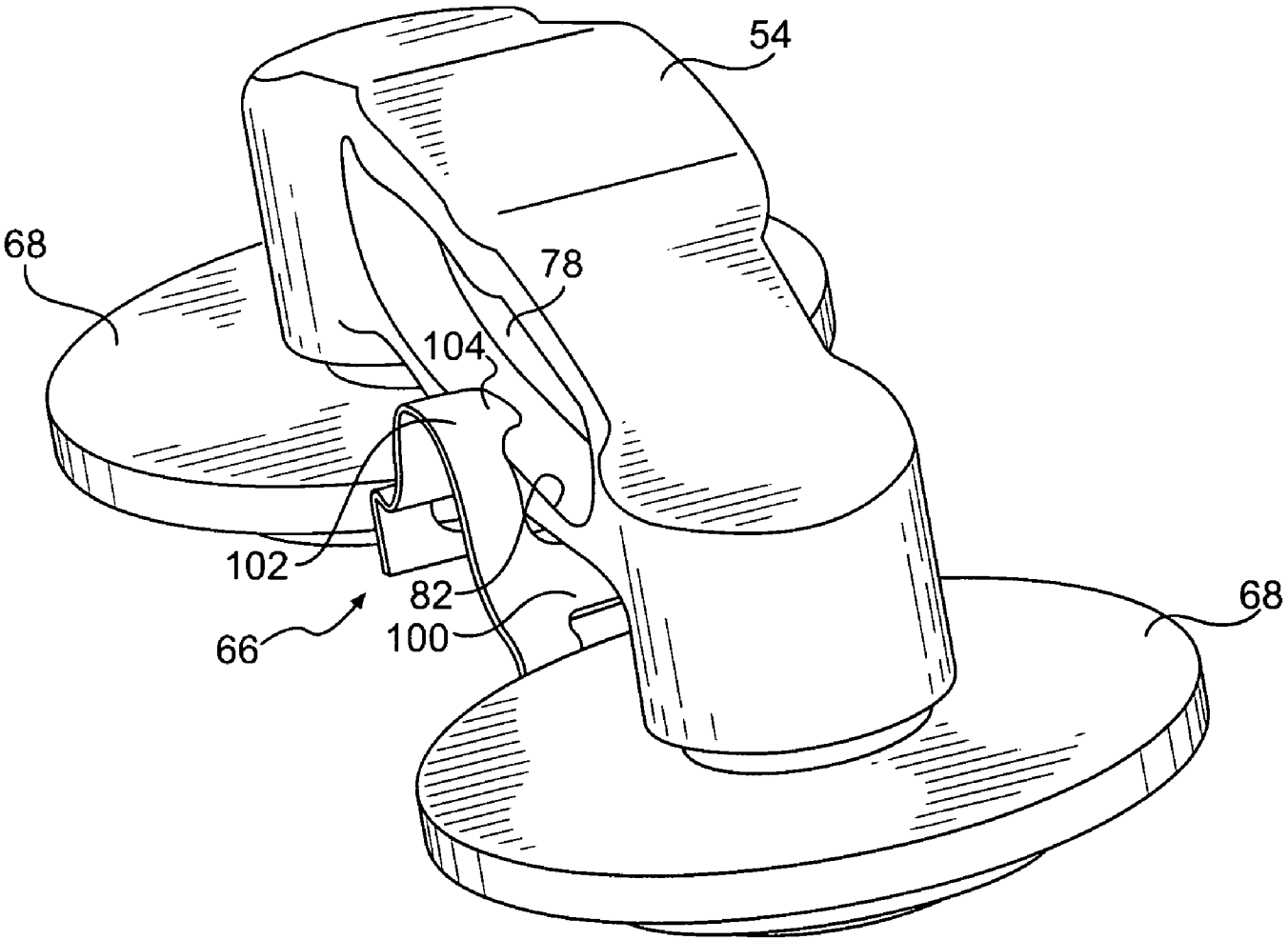
FIG. 8*b* is another view of the retainer in FIG. 8*a;*

In the exemplary embodiment illustrated in FIGS. 8*a* and 8*b*, valve bridge retainer 66 may be a plate-like member with planar extensions at each end, configured to receive a portion of two valve spring retainers 68, and a central opening capable of receiving a portion of valve bridge 54. Valve bridge retainer 66 may also include a first base member 98, a second base member 100, a first latching member 102, a second latching member (not shown), a first protrusion 104, and a second protrusion (not shown). Valve bridge retainer 66 may be located between two spring retainers 68. First base member 98 and second base member 100 may be located underneath valve bridge 54. First latching member 102 may extend from first base member 98 for a distance sufficient to allow first protrusion 104 to overlap a portion of bottom inner surface 82 of central recess 78. First latching member 102 may be curved so as to contact one side portion of valve bridge 54 at approximately the mid-point of valve bridge 54. While FIGS. 8*a* and 8*b* depict the engagement of first latching member 102 with central recess 78, a person of ordinary skill in the art will appreciate that the second latching member (not shown) may engage central recess 78 in a similar manner.

Figure 9A:
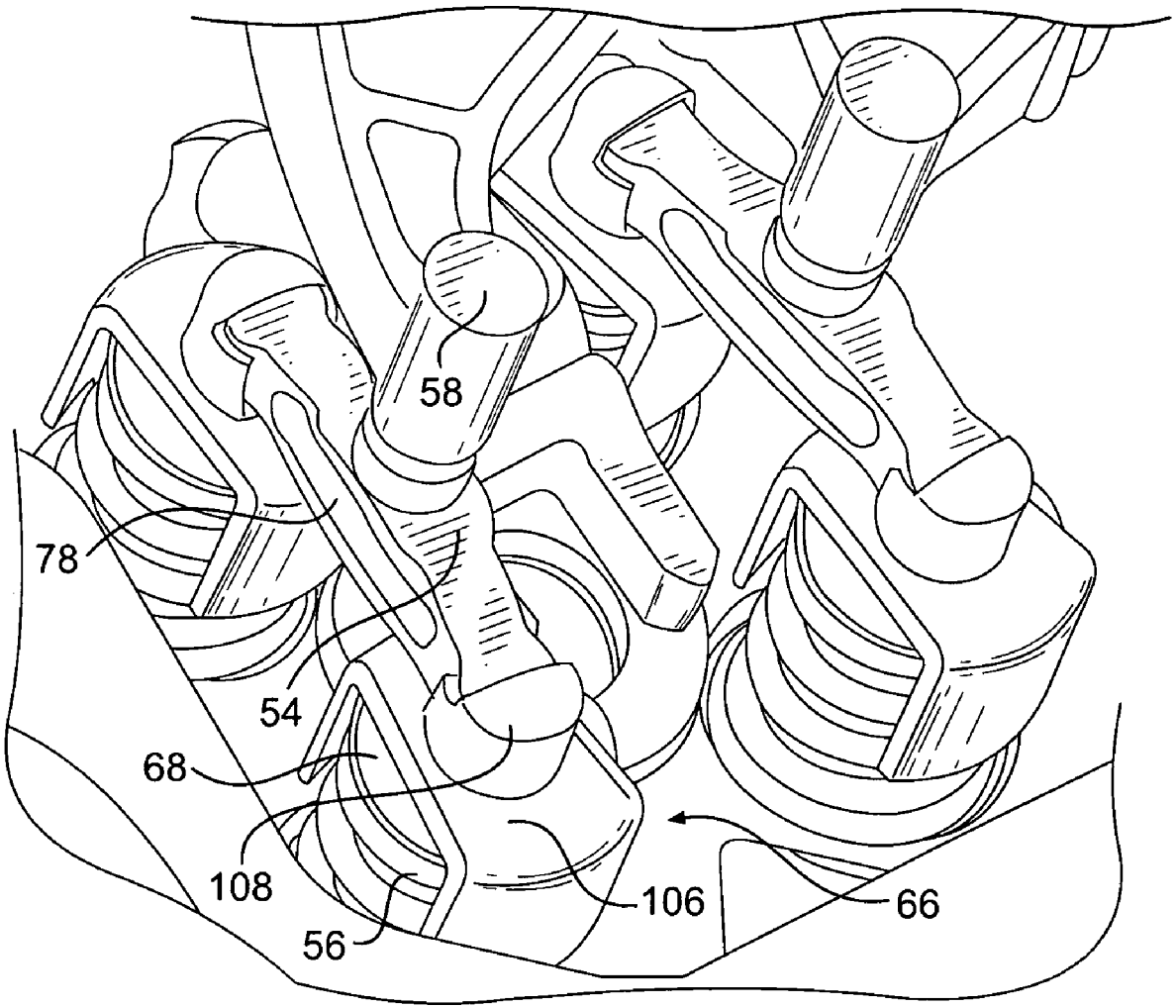
FIG. 9*a* is a diagrammatic view of a retainer for use with the valve bridge in FIG. 2.
Figure 9B:
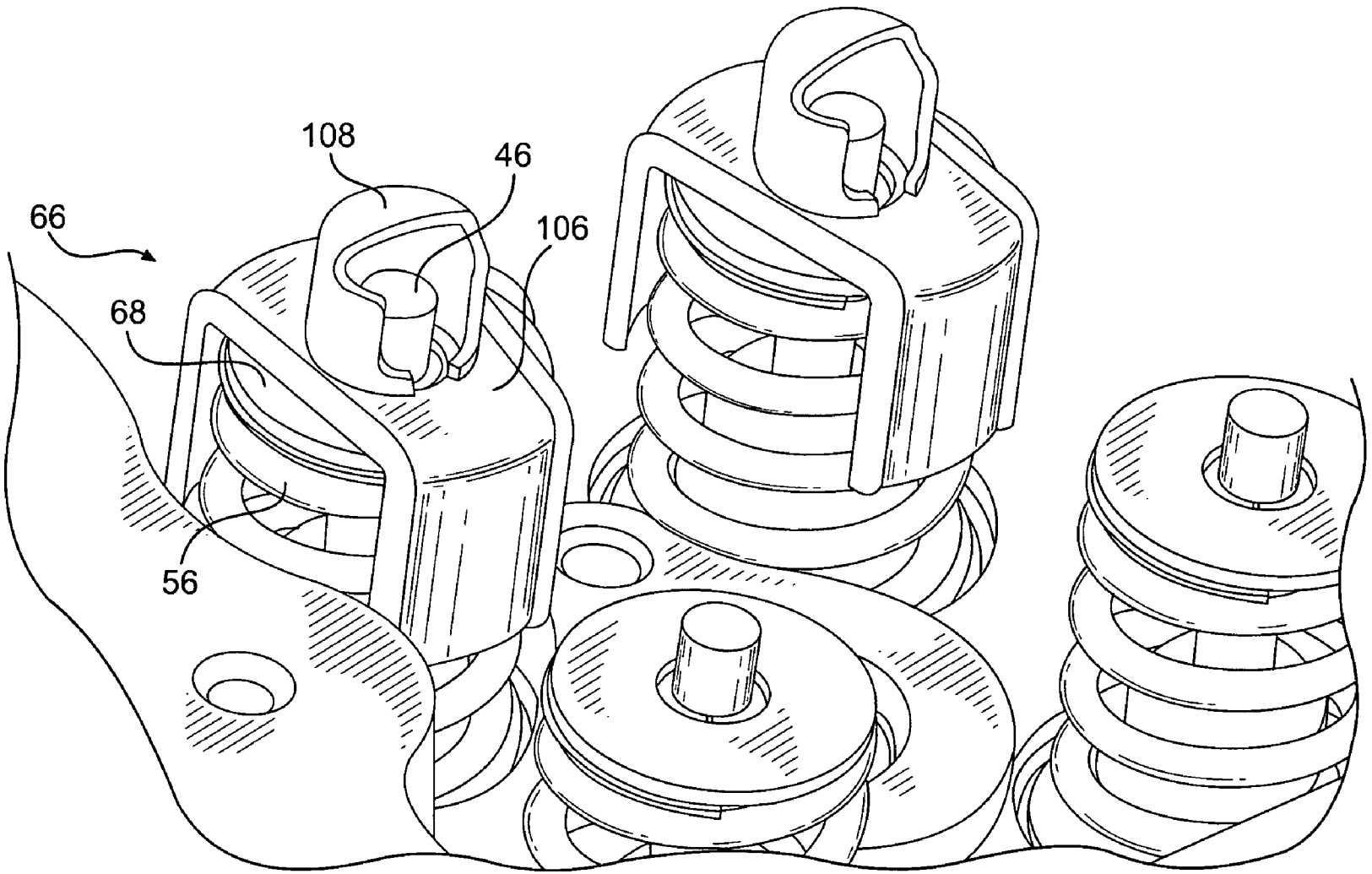
FIG. 9*b* is another view of the retainer in FIG. 9*a;*

In the exemplary embodiment illustrated in FIGS. 9*a* and 9*b*, valve bridge retainer 66 may include a generally cylindrical base member 106 capable of partially enclosing valve spring retainer 68. Base member 106 may include generally rectangular cut-outs on its side portions. Valve bridge retainer 66 may include a latching member 108 extending from base member 106 and partially enclosing an end portion of valve bridge 54. Latching member 108 may also be generally cylindrical in form. Valve bridge retainer 66 may further include indexing members (not shown) to provide better alignment between valve bridge retainer 66 and valve spring retainer 68.

INDUSTRIAL APPLICABILITY

The disclosed device and method for retaining a valve bridge may be advantageously employed in various arrangements where multiple valves are actuated simultaneously with the aid of a valve bridge. For example, the various exemplary embodiments disclosed herein may be employed to retain a valve bridge 54 associated with a pair of intake valves 32 in a single cylinder 22 of engine 20. One skilled in the art will recognize that the disclosed retaining device and method may be used to retain valve bridges in any type of engine where valve bridges may be employed.

In the exemplary embodiments of FIGS. 3*a*-9*b*, valve bridge 54 may be associated with a pair of intake valves 32. Rocker arm 58 may be suitably connected to valve bridge 54. An actuator, such as a cam assembly 110, may act on rocker arm 58 to actuate intake valves 32. Because valve bridge retainer 66 may be constructed from flexible material, in at least some of the exemplary embodiments of FIGS. 3*a*-9*b*, valve bridge retainer 66 may be placed onto valve bridge 54 after valve bridge 54 is engaged with the pair of intake valves 32. For example, in the exemplary embodiment of FIGS. 3*a* and 3*b*, first latching member 72 and second latching member 76 may form a slot capable of receiving valve bridge 54. Valve bridge 54 may be pushed into the slot. Each of first protrusion 84 and the second protrusion (not shown) may then overlap and engage a portion of bottom inner surface 82 of central recess 78. The flexibility of valve bridge retainer 66 will enable ease of assembly. In addition to the use of valve bridge retainer 66, the close ends of valve bridge 54 may help to eliminate movement between valve bridge 54 and the pair of intake valves 32.

It will be apparent to those skilled in the art that various modifications and variations can be made to the retaining device of the present disclosure without departing from the scope of the disclosure. Other embodiments will be apparent to those skilled in the art from consideration of the specification and practice of the retaining device disclosed herein. It is intended that the specification and examples be considered as exemplary only, with a true scope of the disclosure being indicated by the following claims.

What is claimed is:

1. A valve bridge retainer for restricting motion of a valve bridge configured to engage a plurality of valve assemblies, the valve bridge retainer comprising:

a proximal end adjacent the valve bridge and a distal end adjacent a first valve assembly;

a first base member including an open region configured to receive a portion of the first valve assembly; and a first latching member portion located proximal of the first base member, the first latching member portion extending from the first base member and configured to extend over a substantially proximally facing portion of the valve bridge, the first base member and the first latching member portion being configured to restrict motion of the valve bridge relative to the first valve assembly.

2. The valve bridge retainer of claim 1, wherein at least a portion of the first base member is generally planar.

3. The valve bridge retainer of claim 1, wherein the first base member is wire-like.

4. The valve bridge retainer of claim 1, further including a second latching member portion extending from the first base member and configured to extend over the substantially proximally facing portion of the valve bridge.

5. The valve bridge retainer of claim 4, wherein the first and the second latching member portions are configured to flexibly receive and engage side portions of the valve bridge.

6. The valve bridge retainer of claim 4, wherein the first and the second latching member portions are configured to restrict lateral motion of the valve bridge relative to the plurality of valve assemblies.

7. The valve bridge retainer of claim 1, further including:

a second base member including an open region configured to receive a portion of a second valve assembly; and a second latching member portion located proximal of the second base member, the second latching member portion extending from the second base member and configured to extend over the substantially proximally facing portion of the valve bridge, the second base member and the second latching member portion being configured to restrict motion of the valve bridge relative to the second valve assembly.

8. The valve bridge retainer of claim 1, wherein the first latching member portion is configured to engage at least one side portion of the valve bridge.

9. The valve bridge retainer of claim 1, wherein the first latching member portion is configured to extend over a proximal portion of the valve bridge.

10. The valve bridge retainer of claim 1, wherein the first base member is configured to receive a portion of a connecting member of the first one of the plurality of valve assemblies located between a valve element of the first one of the plurality of valve assemblies and the valve bridge.

11. The valve bridge retainer of claim 10, wherein the connecting member is a valve spring retainer.

12. The valve bridge retainer of claim 11, wherein the first base member at least partially surrounds the valve spring retainer.

13. The valve bridge retainer of claim 11, wherein the first base member is configured to extend distal of the valve spring retainer.

14. The valve bridge retainer of claim 11, wherein the first base member is configured to be inserted in a groove defined by the valve spring retainer.

15. The valve bridge retainer of claim 11, wherein the valve spring retainer includes a plurality of radial protrusions.

16. A method of restricting motion of a valve bridge for operating a plurality of valve assemblies simultaneously, comprising:

engaging the plurality of valve assemblies with the valve bridge;

engaging the valve bridge with a retainer including a first portion with an open region and a second portion with a latching member proximal of the first portion;

inserting a portion of a first valve assembly into the open region of the retainer;

positioning the latching member over a substantially proximally facing portion of the valve bridge; and restricting motion of the valve bridge relative to the first valve assembly with the first portion and the second portion of the valve bridge retainer.

17. The method of claim 16, wherein engaging the valve bridge includes securing the latching member to an end portion of the valve bridge.

18. The method of claim 16, wherein restricting motion includes restricting lateral motion of the valve bridge relative to the first valve assembly.

19. The method of claim 18, wherein restricting lateral motion includes extending the latching member over a proximal portion of the valve bridge.

20. The method of claim 18, wherein restricting lateral motion includes connecting the latching member to side portions of the valve bridge.

21. A valve actuating device, comprising:

a valve bridge configured to engage a plurality of valve assemblies;

an actuator configured to engage the valve bridge; and a retaining device configured to be coupled to the valve bridge, including:

a first base member configured to at least partially enclose a portion of a spring assembly of a first valve assembly; and a first latching member located on top of the first base member, the first latching member being configured to at least partially enclose a first end portion of the valve bridge, the retaining device being configured to align the first end portion of the valve bridge with the first valve assembly.

22. The valve actuating device of claim 21, wherein the retaining device further includes:

a second base member configured to at least partially enclose a portion of a spring assembly of a second valve assembly; and a second latching member located on top of the second base member, the second latching member being configured to at least partially enclose a second end portion of the valve bridge, the retaining device being configured to align the second end portion of the valve bridge with the second valve assembly.

23. The valve actuating device of claim 21, wherein at least one of the first base member and the first latching member is substantially cylindrical.

24. The valve actuating device of claim 21, wherein the first base member is generally cylindrical and includes a plurality of substantially rectangular cut-outs on sides of the first base member.

* * * * *